US009802252B2

(12) United States Patent
Nakatani

(10) Patent No.: US 9,802,252 B2
(45) Date of Patent: Oct. 31, 2017

(54) METHOD FOR CONTROLLING POWDER COMPACTING APPARATUS AND COMPACTING APPARATUS

(71) Applicant: TOYOTA JIDOSHA KABUSHIKI KAISHA, Toyota-shi, Aichi-ken (JP)

(72) Inventor: Kazumichi Nakatani, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 15/272,743

(22) Filed: Sep. 22, 2016

(65) Prior Publication Data

US 2017/0095859 A1 Apr. 6, 2017

(30) Foreign Application Priority Data

Oct. 6, 2015 (JP) ..... 2015-198610

(51) Int. Cl.

| | |
|---|---|
| ***B22F 3/03*** | (2006.01) |
| ***B28B 3/08*** | (2006.01) |
| ***B30B 11/02*** | (2006.01) |
| ***B30B 15/28*** | (2006.01) |
| *B30B 7/00* | (2006.01) |

(52) U.S. Cl.

CPC ..... *B22F 3/03* (2013.01); *B28B 3/08* (2013.01); *B28B 3/083* (2013.01); *B22F 2003/033* (2013.01); *B22F 2999/00* (2013.01); *B30B 7/00* (2013.01)

(58) Field of Classification Search

None

See application file for complete search history.

(56) References Cited

U.S. PATENT DOCUMENTS

| | | | | |
|---|---|---|---|---|
| 4,370,119 | A * | 1/1983 | Watanabe | B30B 11/02 425/214 |
| 5,395,565 | A * | 3/1995 | Nagaoka | B29C 43/58 264/320 |
| 5,551,856 | A * | 9/1996 | Katagiri | B22F 5/06 425/195 |
| 2002/0004978 | A1 * | 1/2002 | Yanase | B28B 1/44 29/615 |

(Continued)

FOREIGN PATENT DOCUMENTS

| | | | |
|---|---|---|---|
| JP | H04-147798 | A | 5/1992 |
| JP | H06-25706 | A | 2/1994 |
| JP | 2003-165109 | A | 6/2003 |

*Primary Examiner* — Mary F Theisen
(74) *Attorney, Agent, or Firm* — Oliff PLC

(57) ABSTRACT

There is provided a method for controlling a powder compacting apparatus including: a die having a hollow; an upper punch and a floating lower punch; a first actuator that pushes down the upper punch; a second actuator that controls a floating load of the floating lower punch; and a stopper that defines a pressurization stop position of the floating lower punch. The powder compacting apparatus is configured such that the first actuator is operated to push down the upper punch to pressurize powder charged into the cavity, and the second actuator is controlled to pressurize the powder such that a load acting on the powder during pressurization becomes a prescribed floating load required to compact the powder. The method includes reducing the floating load in a stepwise manner after completion of the pressurization.

4 Claims, 5 Drawing Sheets

(56) References Cited

U.S. PATENT DOCUMENTS

| | | | | |
|---|---|---|---|---|
| 2003/0167819 | A1* | 9/2003 | Olsson | B21J 5/12 72/407 |
| 2005/0186300 | A1* | 8/2005 | Hinzpeter | B22F 3/03 425/78 |
| 2015/0314547 | A1* | 11/2015 | Grobl | B30B 11/005 419/66 |

* cited by examiner

METHOD FOR CONTROLLING POWDER COMPACTING APPARATUS AND COMPACTING APPARATUS

INCORPORATION BY REFERENCE

The disclosure of Japanese Patent Application No. 2015-198610 filed on Oct. 6, 2015 including the specification, drawings and abstract is incorporated herein by reference in its entirety.

BACKGROUND OF THE DISCLOSURE

1. Technical Field

The disclosure relates to a method for controlling a powder compacting apparatus, and relates also to a compacting apparatus.

2. Description of Related Art

One of the methods for compacting powder under pressure is a float compacting method. The float compacting method is carried out by using a powder compacting apparatus that mainly includes a die having a hollow, a floating lower punch that slides in the hollow, an upper punch that is also slidable in the hollow, and various actuators that respectively drive the floating lower punch and the upper punch.

Powder is charged into a cavity defined by the die, the floating lower punch, and the upper punch. Then, the powder is pressurized by pushing down the upper punch by using an actuator, such as a hydraulic cylinder or an air cylinder. At this time, the powder is pressurized while the floating lower punch is slid by an actuator such that a prescribed pressurizing force (floating load) acts on the powder. There is also a powder compacting apparatus in which a stationary lower punch that does not slide is disposed around a floating lower punch, and a cavity is defined by the stationary lower punch, the floating lower punch, a die, and an upper punch.

There is also a powder compacting apparatus configured such that, in addition to a floating lower punch and an upper punch, a die can also be slid by an actuator. In the thus configured powder compacting apparatus, the upper punch and the floating lower punch pressurize powder while descending at prescribed respective rates (speeds). At this time, for example, while the upper punch is descending at a speed of 10 and the floating lower punch is descending at a speed of 7, the die is also descending, for example, at a speed of 8. With this configuration, when the powder is gradually compacted from the vicinity of the upper punch to produce a green compact, it is possible to inhibit the generation of a density distribution in which the density of the green compact decreases with increasing proximity to the upper punch (i.e., a density distribution in which the density of the green compact becomes lower as the distance to the upper punch decreases in the green compact).

In the float compacting method, when the powder is pressurized due to the descending of the upper punch, the operation of the floating lower punch is controlled such that a floating load applied to the powder by the floating lower punch becomes a setting value, and the floating lower punch reaches a stopper that defines a pressurization stop position while maintaining the floating load.

After completion of the pressurization, the floating load is reduced when the green compact obtained by compacting the powder is removed from the die.

SUMMARY OF THE DISCLOSURE

Immediately before the start of reduction in the floating load, the floating lower punch-system components (e.g. the floating lower punch, the actuator that drives the floating lower punch, and a connecting member that connects the floating lower punch to the actuator), which have been floated, are in a state where they are elastically deformed in a compressing direction, as a whole. As the floating load applied from the floating lower punch in the elastically-deformed state is abruptly reduced, the floating lower punch-system components are recovered from the elastically deformed state to a non-elastically-deformed state.

At the time of reduction in the floating load applied from the floating lower punch, the floating lower punch is pushed downward via the green compact by the upper punch. Thus, the elastic recovery of the floating lower punch-system components is turned mainly into a motion of the components disposed below the lower surface of the floating lower punch, which is in contact with the stopper.

The motion of the components is turned into elastic energy of the components disposed below the lower surface of the floating lower punch, which is in contact with the stopper, and then the motion stops.

Therefore, when a high floating load is abruptly reduced, an abrupt motion of the floating lower punch-system components occurs, which may cause damages to the components within a period until the motion stops.

This will be described with reference to FIG. 5 illustrating an upper punch and floating lower punch displacements versus time graph and a load cell load (floating lower punch load) versus time graph.

When the pressurization is completed with a certain floating load applied to the powder, the floating load (the load cell load in FIG. 5) is abruptly reduced to reduce the torque all at once.

Due to the abrupt reduction in the floating load, the connecting member that connects the floating lower punch to the actuator attempts to stretch downward, so that the floating lower punch is pulled until the motion stops. After being pulled, the floating lower punch bounds back to be displaced.

Japanese Patent Application Publication No. 06-25706 (JP 06-25706 A) describes a powder compacting apparatus. In the powder compacting apparatus, a die is movably disposed in a die holder that operates along with a press lower ram, a stationary lower punch and a floating lower punch are disposed on a punch plate of which the position is fixed, the floating lower punch is supported by a cylinder device incorporated in the punch plate, and one end of a connecting rod that operates along with the press lower ram is disposed in a bore of the cylinder device. Powder is held between the floating lower punch and a floating upper punch, and is partially displaced. Then, a piston of the cylinder device is brought into contact with the connecting rod, thereby applying an ascending force of the press lower ram to the powder, so that pre-compacting is performed. Subsequently, the descending of the floating lower punch is stopped by a stopper, and final compacting is performed.

With the powder compacting apparatus described in JP 06-25706 A, using the press lower ram contributes to size reduction and simplification of a powder transport mechanism. However, even when the powder compacting apparatus described in JP 06-25706 A is employed, there is still the aforementioned problem, that is, there is still a possibility that abrupt reduction in a floating load leads to damages to the floating lower punch-system components.

The disclosure is made to address the aforementioned problem, and the disclosure provides a method for controlling a powder compacting apparatus and a compacting apparatus, the method and the compacting apparatus allowing reduction in the possibility of causing damages to floating lower punch-system components due to abrupt reduction in a floating load.

A first aspect of the disclosure relates to a method for controlling a powder compacting apparatus including at least: a die having a hollow; an upper punch and a floating lower punch that slide in the hollow, the upper punch and the floating lower punch defining a cavity along with the die; a first actuator that pushes down the upper punch; a second actuator that controls a floating load of the floating lower punch; and a stopper that defines a pressurization stop position of the floating lower punch. The powder compacting apparatus is configured such that the first actuator is operated to push down the upper punch to pressurize powder charged into the cavity, and the second actuator is controlled to pressurize the powder such that a load acting on the powder during pressurization becomes a prescribed floating load required to compact the powder. The method for controlling the powder compacting apparatus includes reducing the floating load in a stepwise manner after completion of the pressurization.

A second aspect of the disclosure relates to a compacting apparatus. The compacting apparatus includes: an upper punch driven by a first actuator; a floating lower punch disposed below the upper punch, and the floating lower punch being driven by a second actuator to apply a prescribed pressure to an object along with the upper punch; and a stopper that defines a stop position of the floating lower punch. After the prescribed pressure is applied to the object, a pressure applied to the object is reduced in a stepwise manner.

There is provided a method for controlling a powder compacting apparatus including a die having a hollow; an upper punch and a floating lower punch that slide in the hollow, the upper punch and the floating lower punch defining a cavity along with the die; a first actuator that pushes down the upper punch; a second actuator that controls a floating load of the floating lower punch; and a stopper that defines a pressurization stop position of the floating lower punch. The method for controlling the powder compacting apparatus includes: charging powder into the cavity; controlling the first actuator and the second actuator such that a load acting on the powder becomes a prescribed floating load; and reducing the floating load in a stepwise manner after application of the prescribed floating load.

With the method for controlling the powder compacting apparatus according to the disclosure, after completion of the pressurization, control for reducing the floating load in a stepwise manner is executed. Thus, it is possible to effectively prevent the floating lower punch-system components from being damaged due to abrupt reduction in the floating load. In this specification, "reducing the floating load in a stepwise manner" means that the floating load is reduced from a certain value to zero while reduction in the floating load is temporarily stopped one time or two or more times.

In the float compacting method, the control for descending the floating lower punch while the upper punch is descending with a certain floating load maintained is executed, and the operations of the upper punch and the floating lower punch are controlled such that a prescribed floating load acts on the powder until the pressurization is completed.

In order to accurately control the descending of the upper punch and the descending of the floating lower punch at the same time while maintaining a certain floating load, the first actuator and the second actuator are each preferably a servo actuator, such as an electric servomotor.

After completion of the pressurization by the upper punch and the floating lower punch, the floating load is reduced in a stepwise manner, that is, the floating load (i.e., the load cell load) is reduced to a certain low load and reduction in the floating load is temporarily stopped, and then, the remaining floating load is reduced to zero.

Because the floating load is reduced in a stepwise manner as described above, the floating lower punch-system components no longer attempt to stretch downward, and the floating lower punch is no longer pulled until the motion stops. As a result, it is possible to avoid damages to the floating lower punch components due to an attempt of the floating lower punch-system components to stretch downward and pulling of the floating lower punch.

As can be understood from the above description, with the method for controlling the powder compacting apparatus according to the disclosure, it is possible to avoid damages to the floating lower punch components due to abrupt reduction in a floating load, by executing the control for reducing the floating load in a stepwise manner after completion of the pressurization.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein.

DETAILED DESCRIPTION OF EMBODIMENTS

Hereinafter, a method for controlling a powder compacting apparatus according to an example embodiment of the disclosure will be described with reference to the accompanying drawings.

Method for Controlling Powder Compacting Apparatus According to Embodiment

Figure 1:
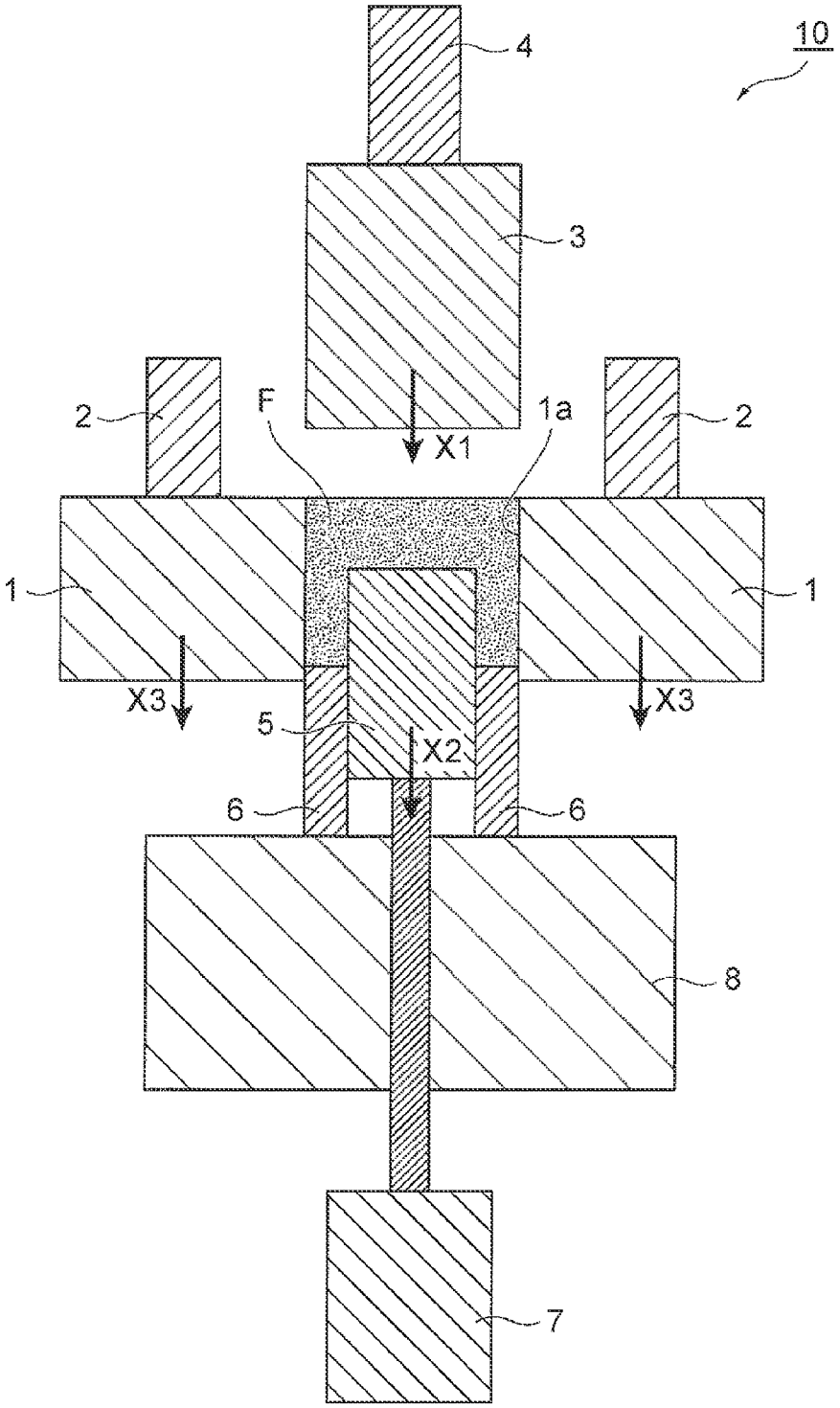
FIG. 1 is a schematic view illustrating a state where powder has been charged into a cavity of a powder compacting apparatus to which a controlling method of the disclosure is applied.
Figure 2:
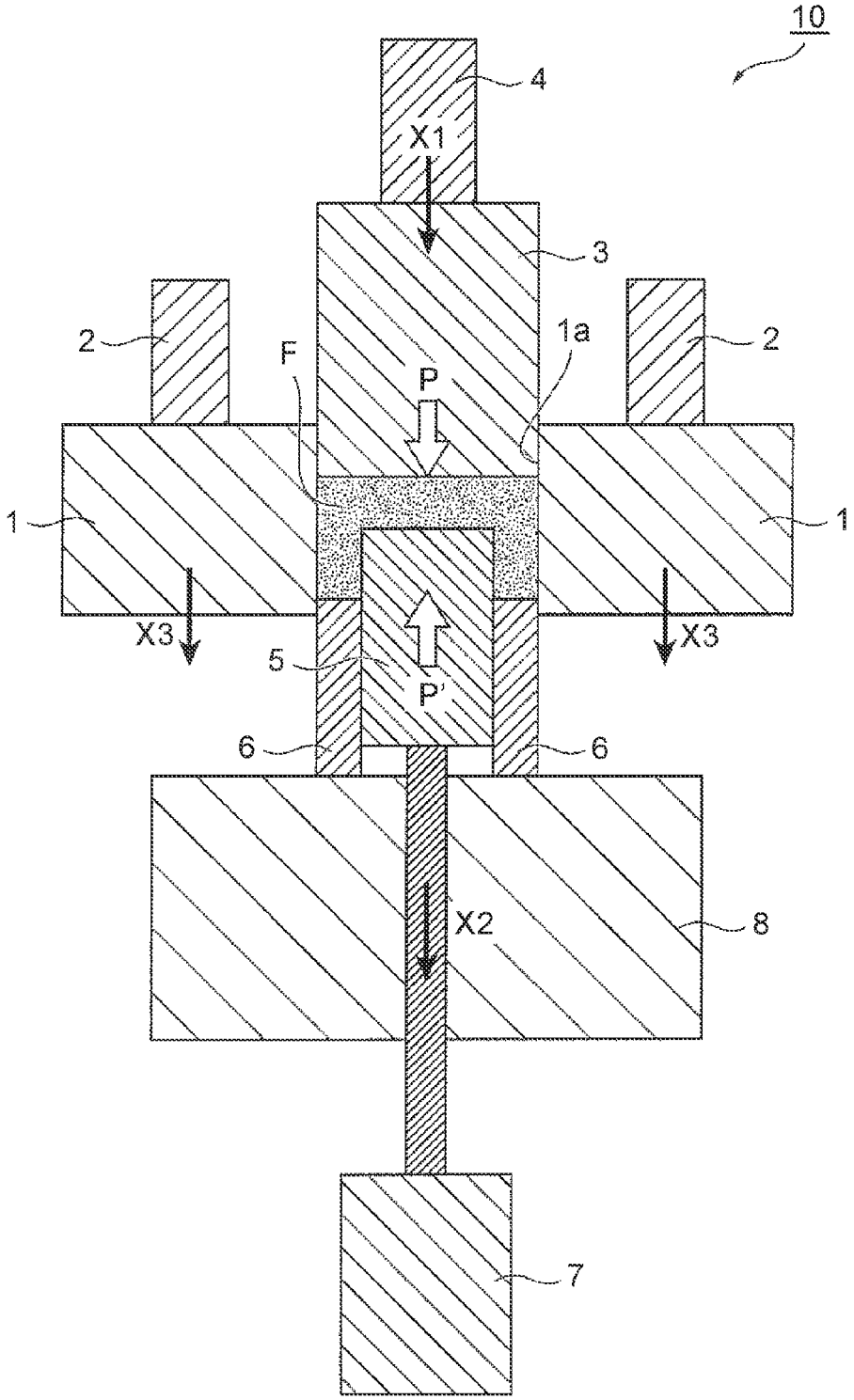
FIG. 2 is a schematic view illustrating a state where the controlling method of the disclosure is carried out to pressurize the powder, thereby forming a green compact.
Figure 3:
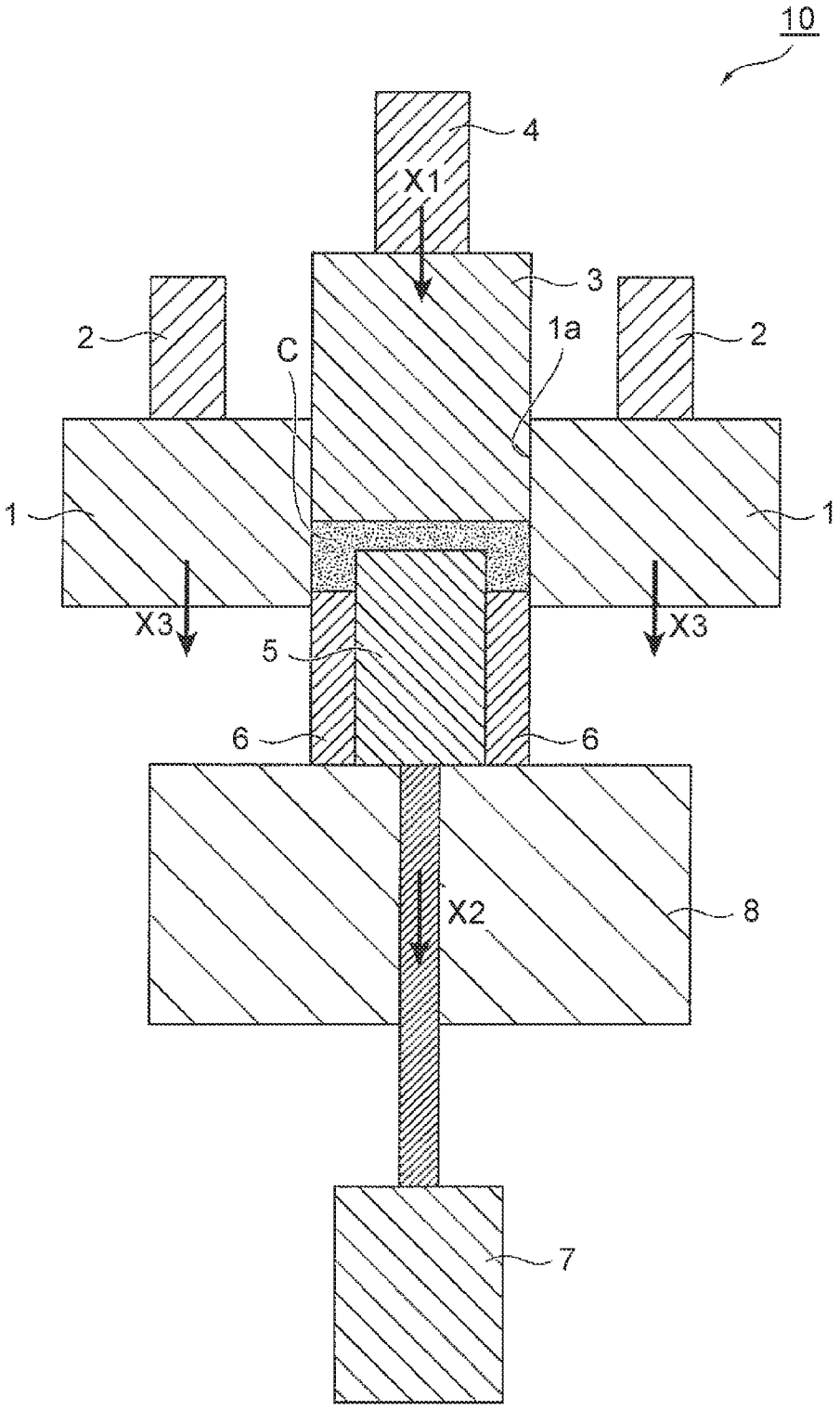
FIG. 3 is a schematic view illustrating a state where a floating lower punch reaches a stopper.
Figure 4:
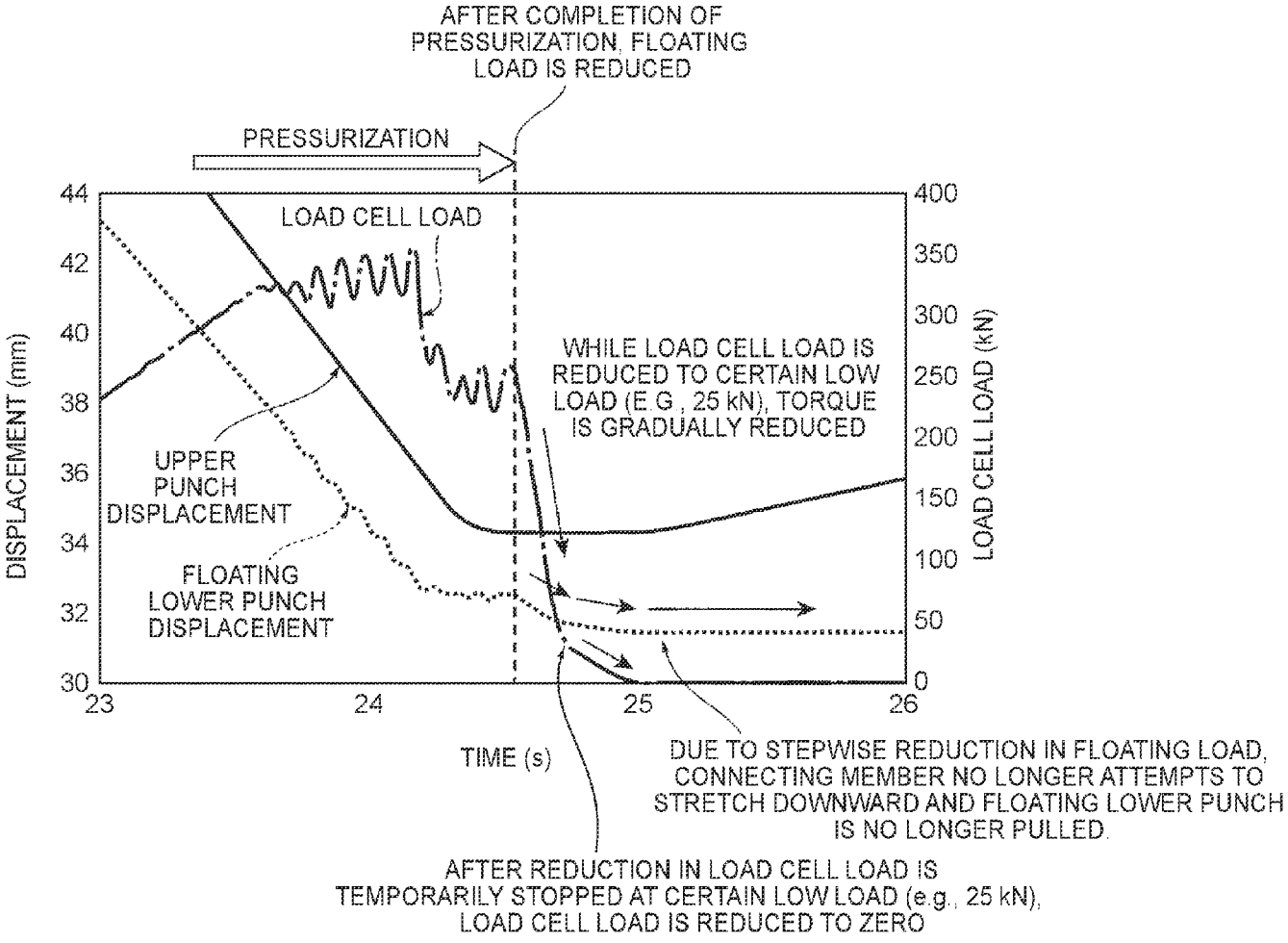
FIG. 4 is a diagram illustrating an upper punch and floating lower punch displacements versus time graph and a load cell load versus time graph, both of which illustrate the controlling method of the disclosure.
Figure 5:
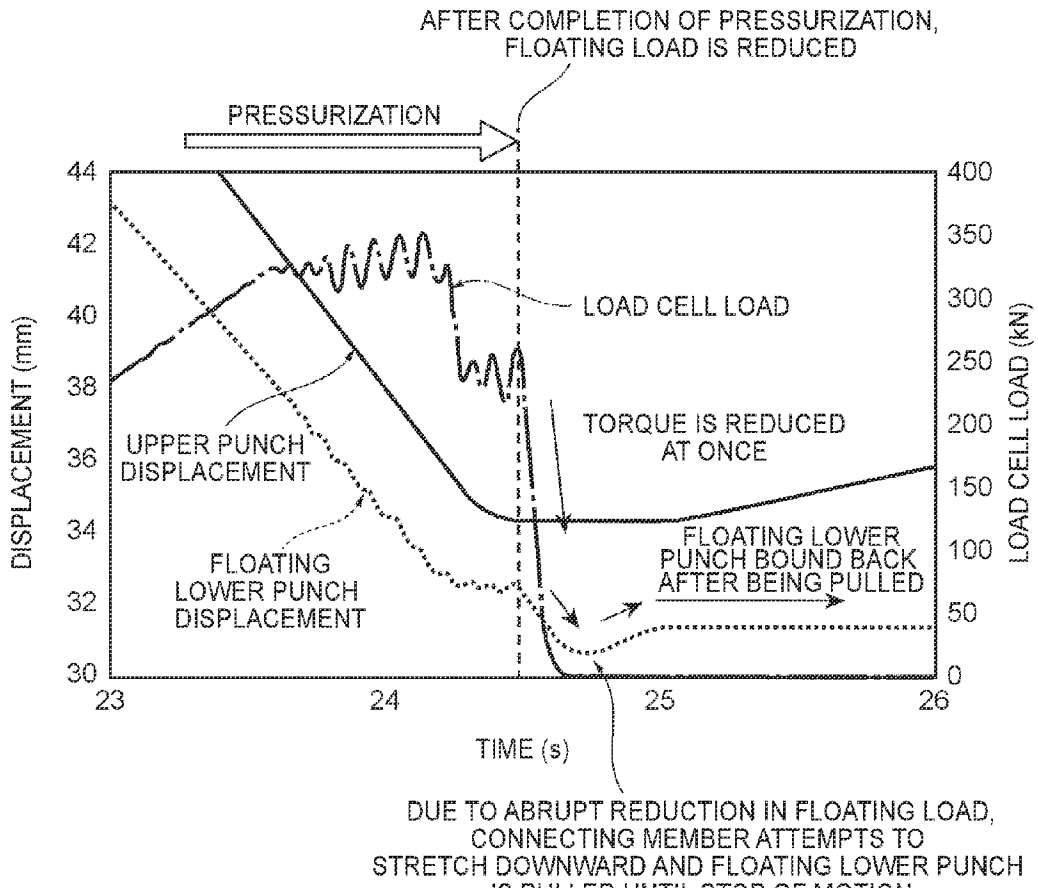
FIG. 5 RELATED ART
FIG. 5 is a diagram illustrating an upper punch and floating lower punch displacements versus time graph and a load cell load versus time graph, both of which illustrate a conventional controlling method.

FIG. 1 is a schematic view illustrating a state where powder has been charged into a cavity of a powder compacting apparatus to which a controlling method of the disclosure is applied. FIG. 2 is a schematic view illustrating a state where the controlling method of the disclosure is carried out to pressurize the powder, thereby forming a green compact. FIG. 3 is a schematic view illustrating a state where a floating lower punch reaches a stopper. FIG. 4 is a diagram illustrating an upper punch and floating lower punch displacements versus time graph and a load cell load versus time graph, both of which illustrate the controlling method of the disclosure.

A powder compacting apparatus 10 illustrated in the drawings mainly includes a die 1 having a hollow 1*a*, a third actuator 2 that slides the die 1 (in a direction X3), an upper punch 3 that slides in the hollow 1*a*, a first actuator 4 that slides the upper punch 3 (in a direction X1), a stationary lower punch 6 that is partially disposed in the hollow 1*a*, a floating lower punch 5 that slides in the stationary lower punch 6, a second actuator 7 that slides the floating lower punch 5 (in a direction X2), and a stopper 8 on which the stationary lower punch 6 is disposed, the stopper 8 defining a descending limit of the floating lower punch 5.

Each of the first actuator 4, the second actuator 7, and the third actuator 2 is constituted by an electric servomotor.

In the powder compacting apparatus 10, during float compacting, a control for causing the floating lower punch 5 to descend (in the direction X2) while the upper punch 3 is descending (in the direction X1) is executed, so that a floating load is applied to powder F due to the descending of the floating lower punch 5. When the descending speed of the upper punch 3 is reduced, the floating lower punch 5 is controlled such that the descending speed of the floating lower punch 5 is also reduced in accordance with the reduction in the descending speed of the upper punch 3.

This control is feasible because each of the first actuator 4 and the second actuator 7 is constituted by a servo actuator (an electric servomotor).

The die 1 is also caused to descend (in the direction X3) by the third actuator 2 (the electric servomotor) while the floating lower punch 5 and the upper punch 3 are descending. With this configuration, when the powder F is gradually compacted from the vicinity of the upper punch 3 to produce a green compact C (see FIG. 3), it is possible to inhibit the generation of a density distribution in which the density of the green compact C decreases with increasing proximity to the upper punch 3 (i.e., a density distribution in which the density of the green compact C becomes lower as the distance to the upper punch 3 decreases in the green compact C).

As illustrated in FIG. 1, a cavity is defined by an inner peripheral surface of the die 1, which defines the hollow 1*a*, an upper surface of the floating lower punch 5, and an upper surface of the stationary lower punch 6. The powder F to be compacted is charged into the cavity.

Next, as illustrated in FIG. 2, the powder F is pressed downward while the upper punch 3 is descending to apply a pressing force P to the powder F. While the upper punch 3 is descending, the floating lower punch 5 is also caused to descend, thereby applying a floating load P' to the powder F. The descending control of the upper punch 3, the floating lower punch 5, and the die 1 is executed while the floating load P' acts on the powder F.

Upon completion of the pressurization, the green compact C having a prescribed shape is obtained, as illustrated in FIG. 3.

The pressurization of the powder F proceeds. After the completion of the pressurization, the floating load is reduced as illustrated in FIG. 4.

During the reduction of the floating load, a load (a load cell load) to be applied to a load cell mounted in the floating lower punch is reduced in a stepwise manner.

Specifically, as illustrated in FIG. 4, the floating load (the load cell load) that is maintained at about 250 kN at the time of completion of the pressurization is reduced to a low load of 25 kN. At this point, the reduction in the load is temporarily stopped.

Next, the load cell load is reduced to zero from 25 kN.

As in the controlling method illustrated in FIG. 4, because the floating load is reduced in a stepwise manner after the pressurization is completed, the floating lower punch-system components (e.g. the actuator that drives the floating lower punch, and a connecting member that connects the floating lower punch to the actuator) no longer attempt to stretch downward, and the floating lower punch is no longer pulled until the motion stops. As a result, it is possible to avoid damages to the floating lower punch components due to an attempt of the floating lower punch-system components to stretch downward and pulling of the floating lower punch.

Because sharp reduction in the floating load can be avoided, damages to the apparatus due to sharp reduction in the floating load can be avoided.

While the embodiment of the disclosure has been described in detail with reference to the drawings, the specific configuration is not limited to the foregoing embodiment, and the disclosure is intended to cover various design changes or the like within the scope of the disclosure.

What is claimed is:

1. A method for controlling a powder compacting apparatus including at least: a die having a hollow; an upper punch and a floating lower punch that slide in the hollow, the upper punch and the floating lower punch defining a cavity along with the die; a first actuator that pushes down the upper punch; a second actuator that controls a floating load of the floating lower punch; and a stopper that defines a pressurization stop position of the floating lower punch, the powder compacting apparatus configured such that the first actuator is operated to push down the upper punch to pressurize powder charged into the cavity, and the second actuator is controlled to pressurize the powder such that a load acting on the powder during pressurization becomes a prescribed floating load required to compact the powder, the method comprising reducing the floating load in a stepwise manner after completion of the pressurization.

2. The method for controlling the powder compacting apparatus according to claim 1, wherein each of both the first actuator and the second actuator is an electric servomotor.

3. A compacting apparatus comprising:

an upper punch driven by a first actuator;

a floating lower punch disposed below the upper punch, and the floating lower punch being driven by a second actuator to apply a prescribed pressure to an object along with the upper punch; and a stopper that defines a stop position of the floating lower punch, wherein the second actuator is configured to reduce a pressure applied to the object in a stepwise manner after the prescribed pressure is applied to the object.

4. A method for controlling a powder compacting apparatus including a die having a hollow; an upper punch and a floating lower punch that slide in the hollow, the upper punch and the floating lower punch defining a cavity along with the die; a first actuator that pushes down the upper punch; a second actuator that controls a floating load of the floating lower punch; and a stopper that defines a pressurization stop position of the floating lower punch, the method comprising:

charging powder into the cavity;

controlling the first actuator and the second actuator such that a load acting on the powder becomes a prescribed floating load; and reducing the floating load in a stepwise manner after application of the prescribed floating load.

* * * * *